United States Patent [19]

Balsamo

[11] 4,285,531

[45] Aug. 25, 1981

[54] REINFORCEMENT FOR COMPUTER PRINTOUT SHEETS

[76] Inventor: Ronald Balsamo, 131 Bogota Gardens, Bogota, N.J. 07603

[21] Appl. No.: 30,116

[22] Filed: Apr. 16, 1979

[51] Int. Cl.[3] ..... B42D 19/00

[52] U.S. Cl. ..... 281/5; 281/2; 282/21 R; 282/11.5 A

[58] Field of Search ..... 402/79, 80 R, 500; 282/1 R, 1 A, 3 R, 5, 7, 12 R, 12 A, 13, 14, 15 R, 15 B, 16 A–16 C, 16 R, 18 R, 18 A, 20 R, 20 B, 21 R, 21 A, 21 C, 21 D, 11.5 R, 11.5 A; 281/2, 5, 1

[56] References Cited

U.S. PATENT DOCUMENTS

| | | | |
|---|---|---|---|
| 740,086 | 9/1903 | Byrne | 402/79 |
| 998,086 | 7/1911 | Simons | 52/286 |
| 1,023,715 | 4/1912 | Bristol | 402/79 |
| 1,439,235 | 12/1922 | Mattivi | 280/43.19 |
| 1,827,638 | 10/1931 | Bingham | 428/84 |
| 1,843,771 | 2/1932 | Kline | 402/79 |
| 2,311,860 | 2/1943 | Otis | 282/11.5 A |
| 2,437,022 | 3/1948 | Fritzinger | 493/347 |
| 2,601,853 | 7/1952 | Hirszon | 402/79 |
| 3,305,247 | 2/1967 | Fulk | 282/11.5 A |
| 4,123,086 | 10/1978 | French | 282/21 R |

FOREIGN PATENT DOCUMENTS

| | | | |
|---|---|---|---|
| 2157493 | 5/1972 | Fed. Rep. of Germany | 282/16 B |

*Primary Examiner*—Paul A. Bell

*Attorney, Agent, or Firm*—Siegmar Silber

[57] ABSTRACT

A binding strip is disclosed for use with continuous paper forms having punched marginal portions and printout pages therebetween, and thereby being adapted for handling by spoked ratchets of paper-advance mechanisms, the binding strip comprises a flat web of material having an adhesive coating on one side thereof; at least two spaced apertures therethrough dimensioned to accept successive spokes of the paper advance mechanism; and a perforation along a line between the spaced apertures so that upon adherence of the binding strip to the continuous paper form, the perforation is adapted to coincide with the printout page edge. A form of the disclosed device is also shown wherein the adhesive coating is barred from a portion of the web adjacent the perforation for facilitating bursting of the form.

4 Claims, 4 Drawing Figures

REINFORCEMENT FOR COMPUTER PRINTOUT SHEETS

BACKGROUND OF THE INVENTION

1. Field of the Invention

The present invention relates to a binding strip for continuous forms sheets, and more particularly to a specially prepared connector/reinforcement for computer printout sheets that are perforated to facilitate separation of printouts into individual sheets. The invention is also applicable to continuous business forms as a connector or reinforcement.

2. Description of the Prior Art

In the past binding strips have been devised for various functional aspects, the most closely related of which are the binding strips designed for mounting blueprints or large architectural drawings onto post binders. Significant in the discussion of this prior art is that the edges of blueprints are frequently fragile or not resistive to mounting stresses so as to tear away readily from binding posts (especially some vellums or parchment which have no particular gram direction). Other prior art devices, which are less directly related to the present invention, are the commonplace, linen-backed reinforcement and variants thereof used for notebook paper that is mounted in ring binders.

In preparing for this application a patentability search was performed which uncovered the following patents:

| Inventor | U.S. Pat. No. | Date of Issue |
|---|---|---|
| Hirszon | 2,601,853 | July 1, 1952 |
| Fritzinger | 2,437,022 | March 2, 1948 |
| Kline | 1,843,771 | Feb. 2, 1932 |
| Bingham | 1,827,638 | Oct. 13, 1931 |
| Mattivi | 1,439,235 | Dec. 19, 1922 |
| Bristol | 1,023,715 | April 16, 1912 |
| Simons | 998,086 | July 25, 1911 |
| Byrne | 740,086 | Sept. 29, 1903 |

Of the patents uncovered, the Kline patent 1,843,771 shows a marginal-punched binding strip which is scored to facilitate adjustment of the length thereof and application to the length of the sheet being reinforced.

As the Kline invention precedes the computer age and the development of continuous business forms, Kline does not anticipate interconnection of business forms. The technology of continuous business forms precedes the computer developments, and, while the forms have changed to accommodate newer high-speed printout machines, the marginal-punched structure for ratchet-controlled advancement of paper of indeterminate length has not changed. Bingham in U.S. Pat. No. 1,827,638 teaches reinforcement for sheets having uniformly spaced apart apertures and further that reinforcement is only required at a few final perforations at each end of the series.

Hirszon, Fritzinger, Mattivi, Bristol, Simons, and Byrne were presented to show other aspects of the art, but were presented in the patentability search as being "of interest" only.

For the handling of computer printouts and continuous business forms, several companies, most notably Wilson Jones, a division of Swingline, Inc., of Chicago, Ill. 60648, have an entire product line devoted to retention, referral and retrieval of printouts including post binders, racks for suspending active printouts for both burst and unburst materials, and accessory easels and the like. The frequent experience of users of such equipment is to find damage to corner holes of the printouts by which these pages are mounted in the binders. The damage besides reducing the retention capability of certain runs may be of such nature as to result in additional machine printouts. The damaged pages arise from machine misalignments, bursting equipment malfunctions or careless handling of printouts.

The presently available printout paper is perforated along both the left-hand and right-hand margins for paper advancement by ratcheted mechanisms. The paper is scored at least transversely to its direction of movement for separation of each page and frequently along each margin for the removal of the marginal-punched area.

The present invention is useful to connect successive pages of printouts without losing the advantage of perforations at the top and bottom of each page, to repair rips along the perforations adjacent the marginal punched area, and to reinforce the corner mounting area.

SUMMARY OF THE INVENTION

A binding strip for continuous forms or computer printout sheets is disclosed which has at least two apertures that are appropriately sized to accommodate the spokes of paper-advance ratchets. Medial the rows is a scored line or perforation to facilitate separation therealong. Opposite the perforation the web of the binding strip extends so as to project upon being adhered to the punched marginal portions of the forms, beyond the perforation of the form onto the edge of the printout page. The binding strip device is utilizable to repair punched marginal portions of continuous forms, to mount computer printouts that have the punched portions removed into post binders, to attach the end of one printout to the beginning of the next, and to reinforce post bound copies of printouts. A form of the device is also shown wherein the adhesive coating is barred from a portion of the web adjacent the perforation for facilitating bursting of the form.

OBJECTS OF THE INVENTION

It is the object of the invention to provide a simple and satisfactory binding strip which can be attached to the edge of a computer printout or continuous business form to afford a firm binding area which is adapted to receive suitable fastening devices.

It is another object of the invention to provide a reinforcing patch of a kind having added reinforcement in the area of greatest stress.

It is a yet further object of the invention to provide a reinforcement which has a sufficiently large web as to bridge the perforation adjacent the marginal-punched area.

It is another further object of this invention to provide a reinforcement which is capable of connecting one computer printout form to the next.

It is yet another further object of the invention to have a portion of the reinforcement ungummed so as to facilitate tearing the reinforcement along the perforation thereof.

Other objects and advantages of the invention will be apparent as it is better understood by reference to the following specifications and drawings.

DESCRIPTION OF THE PREFERRED EMBODIMENTS

The invention disclosed herein is for use with computer printout sheets or continuous business forms.

Figure 1:
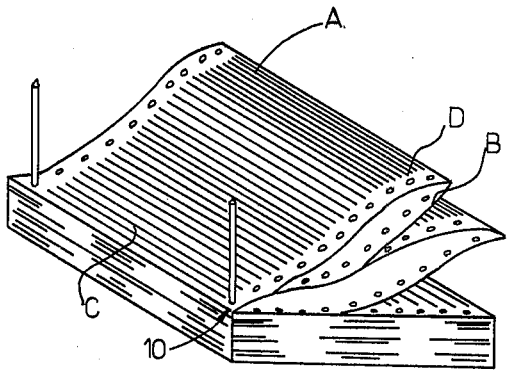
FIG. 1 is a view showing a post binder with a set of unburst marginal-punched forms having a binding strip embodying the present invention attached to at least one face thereof adjacent to one of the edges of the forms.

FIG. 1 shows the device of this invention installed on a computer printout mounted in a post binder, as commonly manufactured by Wilson, Jones, a division of Swingline, Inc., Chicago, Illinois.

Figure 2:
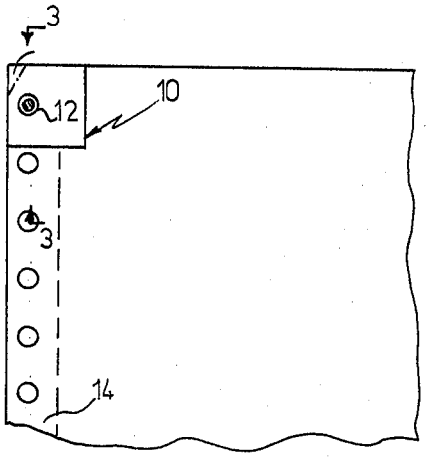
FIG. 2 is an enlarged plan view of a fragment of a form having a binding strip thereon, showing a cross section of a nylon post associated therewith.
Figure 3:
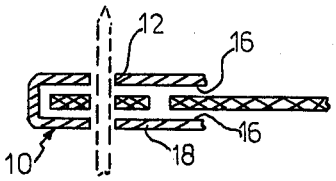
FIG. 3 is a transverse sectional detail view taken substantially on line 3–3 of FIG. 2.
Figure 4:
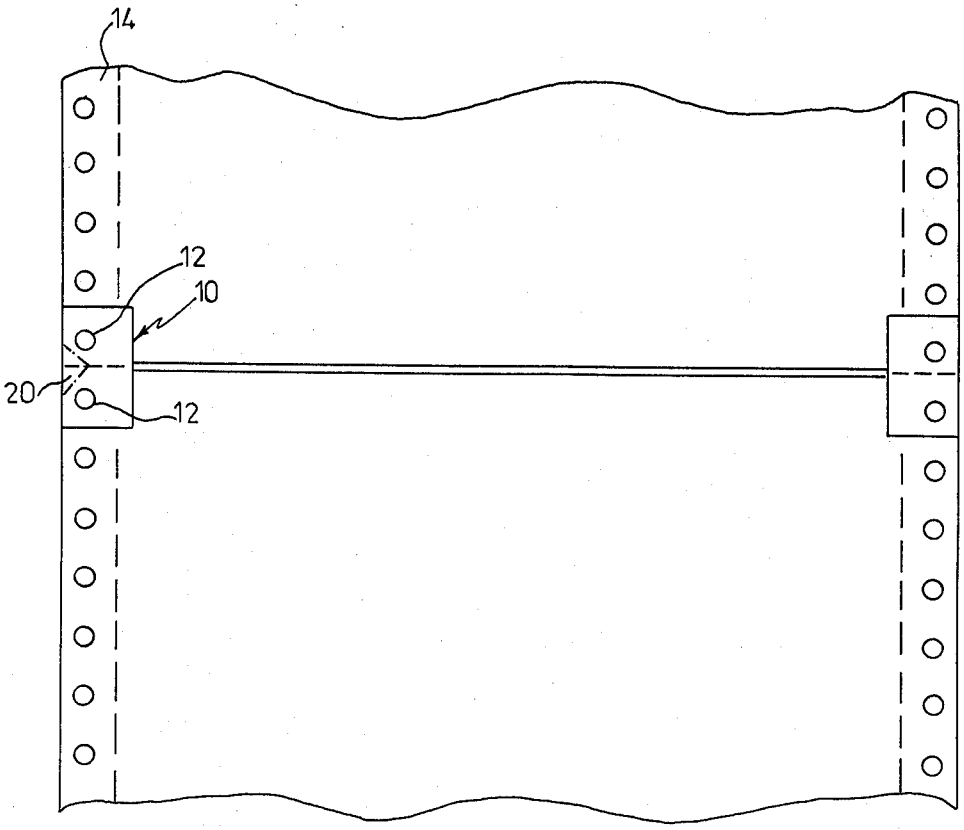
FIG. 4 is an enlarged plan view of a fragment of two adjacent forms having a binding strip connecting.

Referring now in more detail to FIG. 1, there is shown generally a binding strip indicated as reference designator 10. The binding strip is shown attached to a computer printout A which in turn has a punched marginal portion B, a computer printout page C, and a perforation D therebetween. The binding strip which is shown in more detail in FIGS. 2 through 4 is constructed from a web of flexible material and is shown as having spaced apertures 12. The apertures are attached for use with ratchet wheels, commonly contained in paper-advance mechanisms of the printing components of peripheral equipment, either data processing or computer processing units. These mechanisms are commonly spoked so that the circumferential distance between the center of adjacent spokes is approximately ½ inch. The spacing between adjacent holes of the binding strips that run parallel to the direction of movement of the printout or continuous business form is arranged so that the center-to-center spacing is also ½ inch. The apertures themselves are ¼ inch in diameter so as to be compatible with commonly available forms. In the simplest unit a two-hole reinforcement is shown wherein medial the two holes is a perforation transversed to the line between the hole centers. The binding strip is thus constructed so that upon installation of the strip onto a computer printout form the holes thereof can be alined with the punched holes of the marginal portion and the perforation 14 is constructed to be alined with the perforation between adjacent printout pages. One surface 16 of the binding strip is coated with an adhesive material 18. This adhesive material may be selected from water-soluble gums or any of a variety of pressure-sensitive adhesives. No claim of novelty is made to the nature of the adhesive employed. The binding strip 10 may be so constructed as to upon installation have the web 20 of the strip extend beyond the perforation of the computer printout. With such a structure the printout may be inserted into a post binding device with the use of the binding strip whether or not the marginal portion is still intact.

Referring now to FIG. 4 adjacent portions of separated computer printouts are shown. The binding strip is structured so as to connect the end of one printout to the beginning of the next.

To facilitate bursting of forms that have used the binding strip of this invention, a separate embodiment is shown in which the adhesive coating 18 is barred from a portion 20 of the area adjacent the perforation 14. This facilitates tearing away of two adjacent pages even though they are connected by a reinforcement device such as is disclosed in this invention.

It will be evident that various changes may be made by those skilled in the art which will come within the scope of my invention and it is to be desired not to be limited to the uses herein described.

What is claimed is:

1. An improved computer printout sheet comprising, in combination:

a continuous paper form having punched marginal portions and printout pages therebetween being adapted for handling by spoked ratchets of paper-advance mechanisms;

a binding strip having a flat web of reinforcing adhered thereto;

said binding strip with at least two spaced apertures therethrough dimensioned to accept successive spokes of said paper advance mechanism; and a perforation along a line between said spaced apertures so that with said binding strip adhered to said continuous paper form, the perforation is adapted to coincide with the printout page edge, whereby said binding strip is adapted to connect the punched marginal portion of two adjacent ones of said continuous paper forms.

2. An improved computer printout sheet as described in claim 1 wherein said apertures have an approximate diameter of ¼ inch (0.64 cm) with center-to-center spacing of approximately ¼ inch (1.2 cm).

3. An improved computer printout sheet as described in claim 1 wherein said binding strip is a continuous strip of indeterminate length being adapted for dispensing in two-aperture units and multiples thereof.

4. An improved computer printout sheet as described in claim 1 whereby said binding strip is adapted to strengthen the punched marginal portion of the form.

* * * * *